United States Patent [19]

Yamamoto et al.

[11] Patent Number: 4,561,182

[45] Date of Patent: Dec. 31, 1985

[54] ELECTRIC CAN OPENER

[75] Inventors: Osamu Yamamoto, Nagoya; Senichiro Norizuki, Aichi, both of Japan

[73] Assignee: Kabushikikaisha Aichidenkikosakusho, Japan

[21] Appl. No.: 550,670

[22] Filed: Nov. 10, 1983

[30] Foreign Application Priority Data

May 25, 1983 [JP] Japan ..... 58-93091

[51] Int. Cl.[4] ..... B67B 7/30

[52] U.S. Cl. ..... 30/433; 30/100; 30/408; 30/410; 30/419

[58] Field of Search ..... 30/433, 408, 410, 419, 30/400; 308/3 A

[56] References Cited

U.S. PATENT DOCUMENTS 1,689,301 10/1928 Ryckman ..... 30/433
3,002,274 10/1961 Jepson et al. ..... 30/410
3,178,813 4/1965 Colgdon ..... 30/419

*Primary Examiner*—E. R. Kazenske
*Assistant Examiner*—Willmon Fridie, Jr.
*Attorney, Agent, or Firm*—William A. Drucker

[57] ABSTRACT

An electric can opener comprising an opener body and a body support. The opener body includes a cutter and a toothed wheel adapted to be rotated by an electric motor. A can to be opened is placed on the wheel at its upper projecting edge, and rotated by the wheel as operated by the motor. During rotation the top of can is cut by the cutter. For usual use, the opener support can be placed on the upper surface of an object such as a kitchen table with its bottom in contact with the upper surface. For use in suspension, the support can be secured to the lower surface of a fixed object such as a hanged sideboard by installing its bottom to the lower surface. For usual use, the base of the support is located below the opener body. For use in suspension, the base of the support is located above the body.

2 Claims, 41 Drawing Figures

ELECTRIC CAN OPENER

BACKGROUND OF THE INVENTION

1. Field of the Invention

This invention relates to an electric can opener including a toothed wheel adapted to be operated by an electric motor for rotating a can and a cutter for opening the can during rotation thereof.

2. Description of the Prior Art

Conventional electric can openers for use on a kitchen table or dresser require no small space for taking the opener into keeping when it is not in use. Therefore, although the opener does not present serious problems in a kitchen with a large space, the users in a small kitchen may be inconvenienced when finding the keeping space. Another type of commercially available electric opener is that used in suspension from a fixed object such as a hanged sideboard. Where the sideboard is located at a relatively higher level and within the arm's length of all users, the opener installed to such a sideboard is not only convenient for use, but provides a sufficient space therebelow to be used for other kitchen work when the opener is not in use. However, if the users are quite different in their statures, a person of small height may find it impossible to reach the opener at such a level, requiring a stool therefor. Also, if an opener is suspended from a sideboard located at a low level, the kitchen worker may be disturbed thereby or beat her head against it when doing a work other than opening a can.

SUMMARY OF THE INVENTION

It is an object of the invention to provide an electric can opener which enables the opening operation to be easily made by cutting the top of a can while rotating the can with a toothed wheel as operated by an electric motor.

Another object of the invention is to provide an electric can opener which can be not only placed on a kitchen table of the usual height, i.e., one whose top is practically level with the waist of a kitchen worker, but also suspended from a hanged sideboard as located at a similar level as the shoulder of the worker or a higher place, and is convenient for either use.

A still another object of the invention is to provide an electric can opener of the character stated above for a which a desired one of the above-mentioned two different types of uses can be selected to suit the user's own convenience.

An electric can opener purchased for domestic use on a kitchen table may be found disturbing for the kitchen works other than opening cans. The base of the opener herein, however, can be located above its body as desired. Therefore, if the customer finds himself in the foregoing situation for the opener herein, he may secure the base of the opener to the lower surface of a hanged sideboard, thus enjoying its convenient use in suspension therefrom against his initial intention. In contrast with this, the opener may be used on a table even if it has been purchased for use in suspension. In short, the customer may purchase the opener herein without having an unquiet feeling about any inconvenience caused by the actual use thereof in his kitchen or the like. In addition, the opener purchased can be employed in such a manner as to suit the user's own convenience.

Other objects and advantages of the invention will become apparent during the following discussion of the accompanying drawings.

BRIEF DESCRIPTION OF THE DRAWINGS

FIG. 26 is a perspective view of an opener body and its support to be connected with each other for use on a table;

FIG. 27 is a perspective view of the opener assembled by connecting the components of FIG. 26;

FIG. 28 is a perspective view of the opener body and its support similar to FIG. 26, but illustrates the components for connection in suspension;

FIG. 29 is a perspective view of the opener assembled by the components of FIG. 28;

FIG. 30 is a partly sectional side view of the third embodiment;

FIG. 31 is a cross section taken on the line XXXI—XXXI of FIG. 30;

FIG. 32 illustrates a pin connecting a body and a support of the opener of FIG. 30 and a portion surrounding the pin;

FIG. 33. is a perspective view of the opener of FIG. 30 as installed in suspension;

FIG. 34 is an exploded perspective view of the fourth embodiment in preparation for suspended installation;

FIG. 35 is a perspective view of the opener of FIG. 34 as installed in suspension; and FIG. 36 illustrates how to install the opener of FIG. 34 for suspension and details of the installation.

DESCRIPTION OF THE PREFERRED EMBODIMENTS

Figure 5:
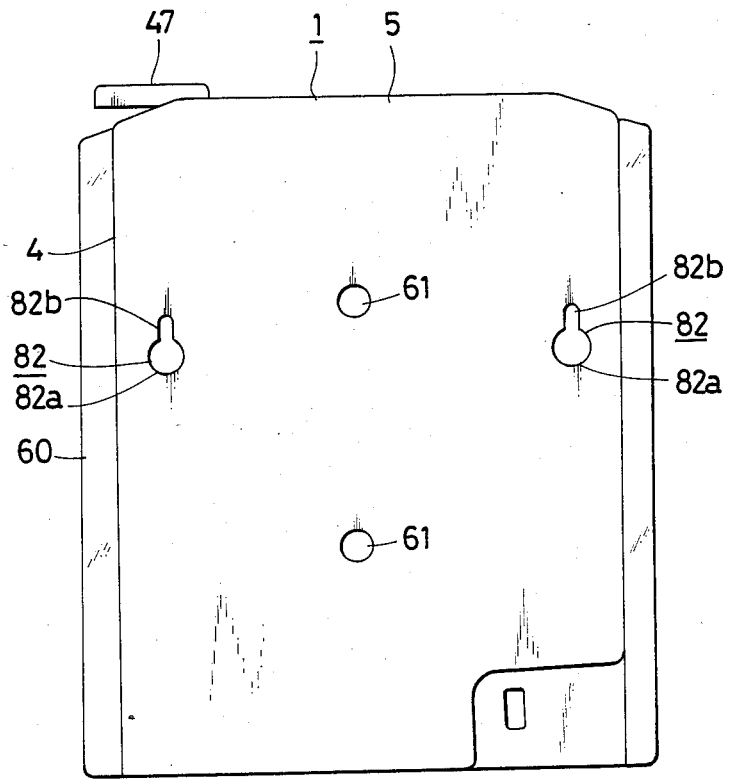
FIG. 5 is a rear elevation of the body of the opener of FIG. 1.
Figure 6:
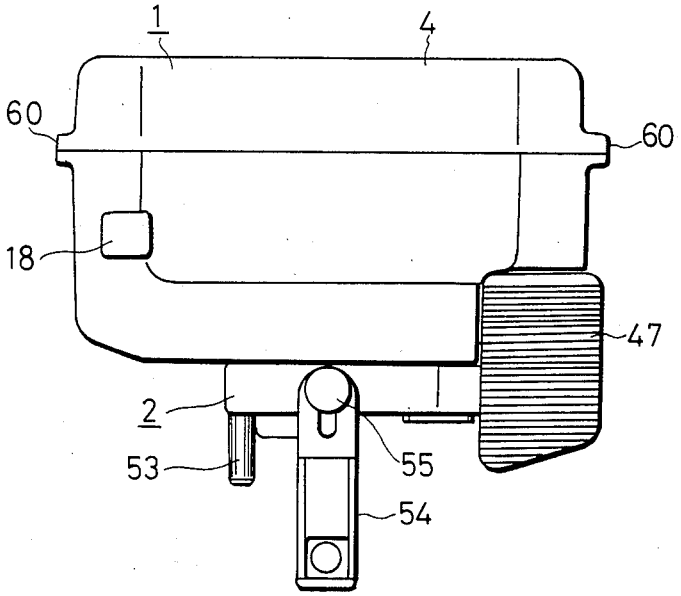
FIG. 6 is a plan view of the body of the opener of FIG. 1.
Figure 8:
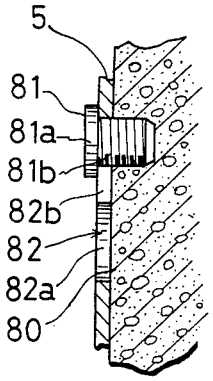
FIG. 8 illustrates details of the installation as shown in FIG. 7.
Figure 7:
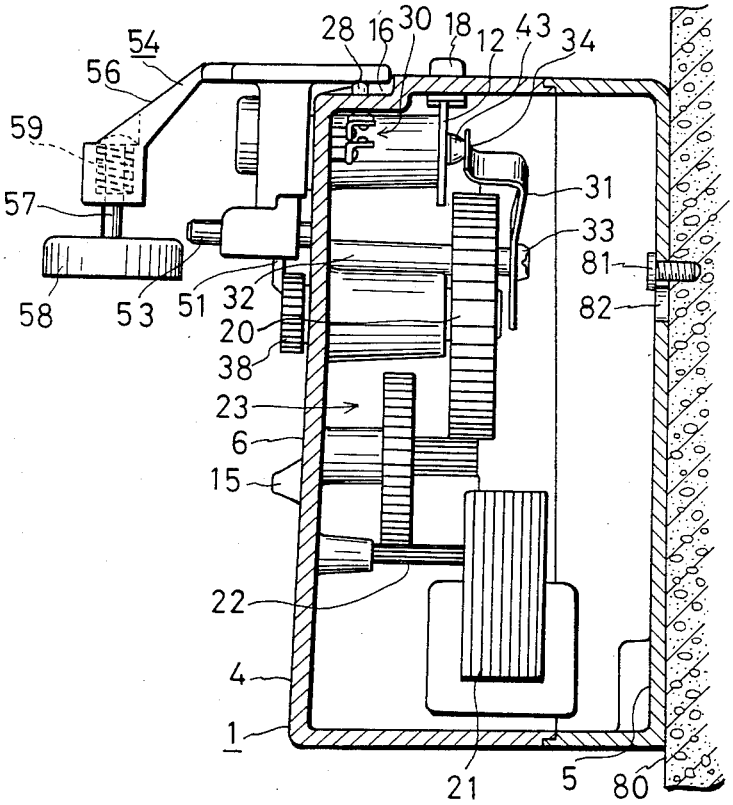
FIG. 7 is a vertical section of the opener of FIG. 1 in installation to a wall.
Figure 9:
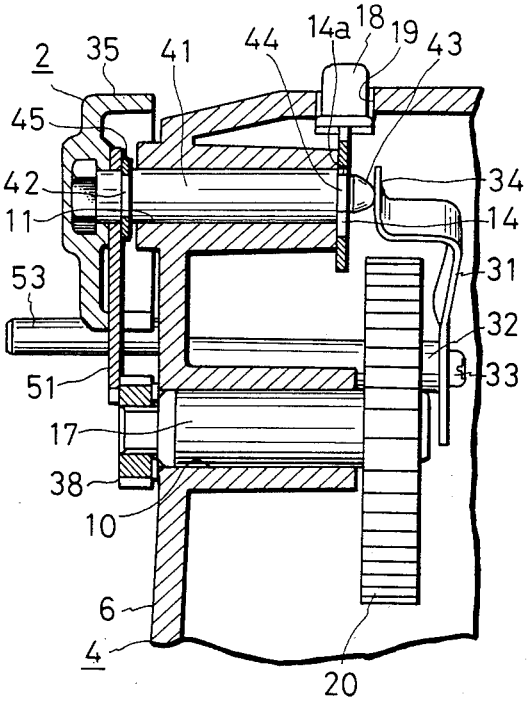
FIG. 9 is an enlarged cross section taken on the line IX—IX of FIG. 4.
Figure 10:
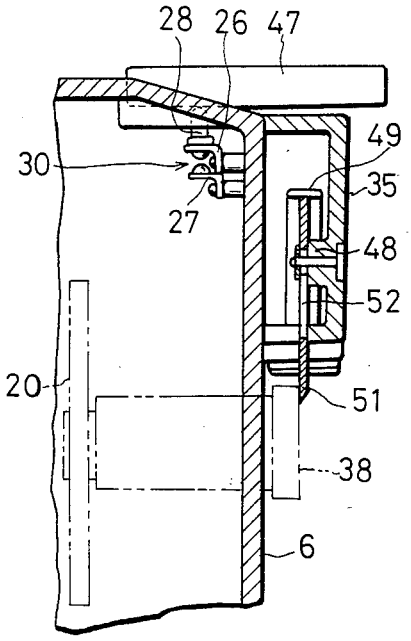
FIG. 10 is an enlarged cross section taken on the line X—X of FIG. 4.
Figure 11:
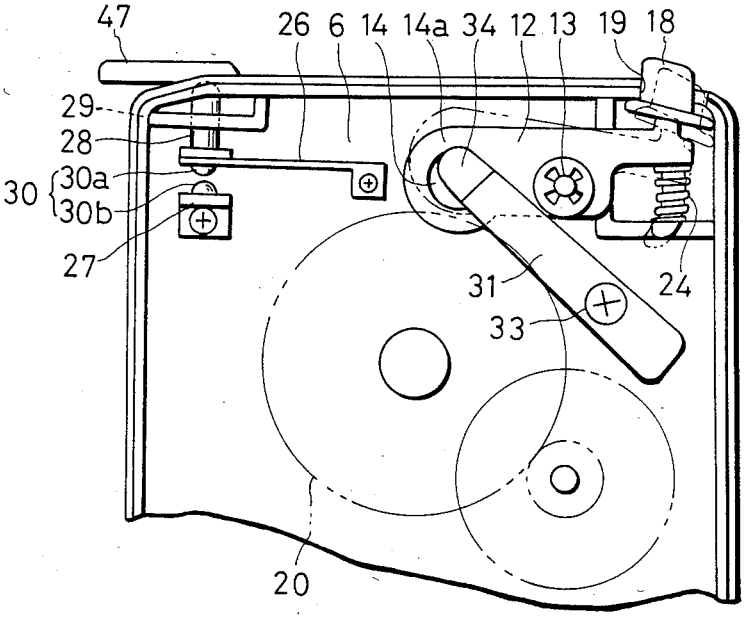
FIG. 11 is, a rear elevation of an important section of the body of the opener of FIG. 1.

Referring now to the drawings (FIGS. 1 to 25), an electric can opener comprises an opener body 1 and a body support 3. The opener body 1 includes a case 4 of metal or synthetic resin which is sized to the minimum. A rear wall 5 of the case 4 is provided with a pair of openings 82 through which bolts 81 are screwed into a wall or the like 80 so as to attach the case 4 thereto (FIGS. 5, 7, and 8). A front wall 6 of the case 4 is provided with a drive-shaft opening 10 located near the center thereof and also provided with an installation opening 11 located not directly but angularly above the drive-shaft opening 10 (FIG. 9). Inside the case 4 is provided a holder means 12 in the proximity of the installation opening 11 (FIGS. 7 and 11). The holder means 12 can be moved, in indicated directions (FIG. 11), on a pin 13 fixed to the case 4. An opening 14 is provided through one end of the holder means 12, while a button 18 is provided, at its other end, for removing the holder means 12 from the case 4. The button 18 is located in an opening 19 provided through a portion of the case 4, and projects upward therefrom. A spring 24 is disposed between the end of the holder means 12 where the button 18 is provided and the case 4 (or case wall). The spring 24 is adapted to urge the holder means 12 in such a direction and manner as to locate the top edge 14*a* of its opening 14 slightly above the axis of the installation opening 11. A pusher means 31 is disposed in close proximity to the holder means 12. The pusher means 31 is of resilient sheet metal press formed into the shape as shown in FIGS. 7, 9, and 11, and is fixed to a support 32, formed integrally with the case 4, by means of a set screw 33. One end (upper end) 34 of the pusher means 31 is located directly opposite to the opening 14 of the holder means 12. The front wall 6 of the case 4 is provided with a can support 15 projecting therefrom below the drive-shaft opening 10 and is also provided with a recess 16 at a corner of the top thereof (FIG. 7).

A drive shaft 17 is rotatably inserted into the opening 10 (FIG. 9). The drive shaft 17 is provided with a gear 38 for rotating a can at its front end (projecting from the case 4) and with a larger-sized gear 20 at its rear end (located inside the case 4). The gear 20 is meshed with a reduction gear 23 which in turn is meshed with a gear 22 provided on a drive shaft of a drive motor 21 (FIG. 7). A power cord 25 having an attaching plug at its one end is connected to the drive motor 21 by way of a switch means 30, thereby enabling the motor 21 to be operated with the usual power supplied for domestic use. Inside the case 4 a movable piece 26 and a fixed piece 27 are provided below and in close proximity to the recess 16 on the top of the case 4 (FIGS. 10 and 11). The movable piece 26 comprises a leaf spring secured to the front wall 6 of the case 4 at its one end, and the fixed piece 27 is also attached to the front wall 6. The pieces 26 and 27 are vertically spaced apart from each other. One end of the movable piece 26 (opposite to its end secured to the wall 6) is provided with a push button 28 extending through an opening 29 made in the bottom of the recess 16 and projecting into the recess 16. Also, the end of the movable piece 26 opposite to its secured end is provided with a contact 30*a*, and the fixed piece 27 is also provided with a similar contact 30*b* which is located directly below the contact 30*a*. The contacts 30*a* and 30*b* make up the foregoing switch means 30 wherein the upper contact 30*a* is brought in touch with the lower one 30*b* by depressing the push button 28.

Figure 12:
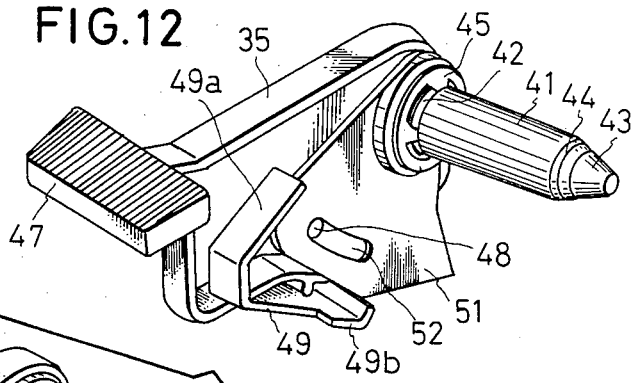
FIG. 12 is a perspective view of an opener attachment mounted to the opener of FIG. 1.
Figure 13:
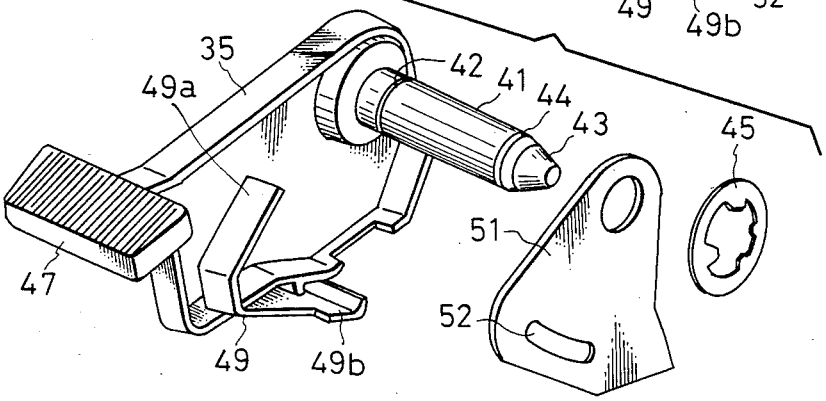
FIG. 13 is an exploded perspective view of the attachment of FIG. 12.

An attachment 2 is removably mounted to the front side 6 of the case 4. The attachment 2 includes a base or frame 35 of synthetic resin (FIGS. 12 and 13). From a corner of the frame 35 projects a metallic pin 41 which is tapered at its end 43 (FIGS. 9, 12 and 13). The pin 41 has an annular engagement groove 44 located in the proximity of its extreme end. A manual-operation section 47 is formed integrally with the frame 35. The greater part of the operation section 47 is located directly above the recess 16 on the case 4, and the section 47 rests on the push button 28 most of the time (as seen from FIG. 24 that will be hereafter referred to). From the inner surface of the frame 35 projects a pin 48 in the same direction as the pin 41. Also, a trapezoid-shaped leaf spring 49 is securely fastened to the inner side of the frame 35 at its middle portion. An upper end 49*a* of the spring 49 is adapted to urge a cutter 51 (as hereafter described) downward, while a lower end 49*b* thereof is adapted to press against the upper projecting edge 50*a* of the can 50 when the opener is in operation. The cutter 51 is pivotably mounted onto the base of the pin 41, and is protected against removal by means of a retaining ring 45 as fitted into a groove 42 on the pin 41. The cutter 51 is provided with a long-sized opening 52 for receiving the foregoing pin 48. The upper end of the opening 52 is brought into contact with the pin 48 by the upper end 49*a* of the spring 49 urging the cutter 51 downward. From the top of the frame 35 hangs down a means 54 for holding the top of the can which includes an arm 56 removably mounted, at its upper end, to the top of the frame 35 by a fastener 55 and a magnet 58 for attracting the top of can removed, the arm 56 and the magnet 58 being connected to each other by a vertically-movable rod 57 which is disposed therebetween (FIG. 7). The movable rod 57 is constantly urged upward by a spring 59 so that the magnet 58 does not prevent the projecting edge 50*a* of the can 50 from being placed on the drive gear 38. Incidentally, the construction consisting of the can-rotating gear 38 and the opener attachment 2 may be referred to as a "can-opening mechanism".

The case 4 of the opener body 1 is provided, at its both sides, with guide sections 60 which extend along the entire lengths of the side walls so as to connect the body 1 with the body support 3. The rear wall 5 of the case 4 is provided with a pair of engagement openings 61 (in addition to the installation openings 82) (FIG. 5).

Figure 1:
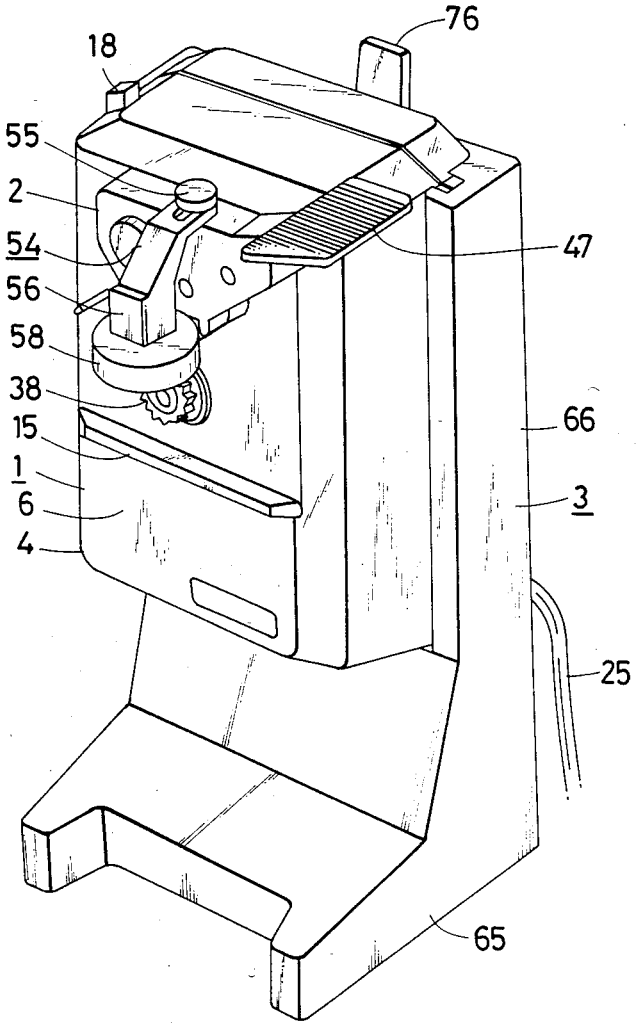
FIG. 1 is a perspective view of an electric can opener according to the invention.
Figure 2:
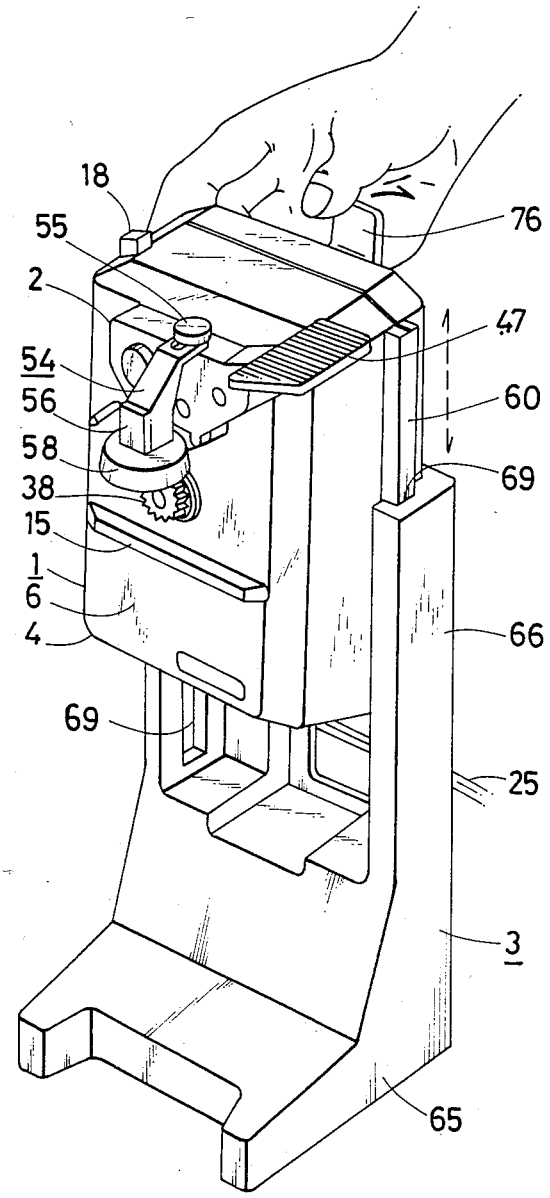
FIG. 2 illustrates an adjustment of the level of a body of the opener of FIG. 1.
Figure 3:
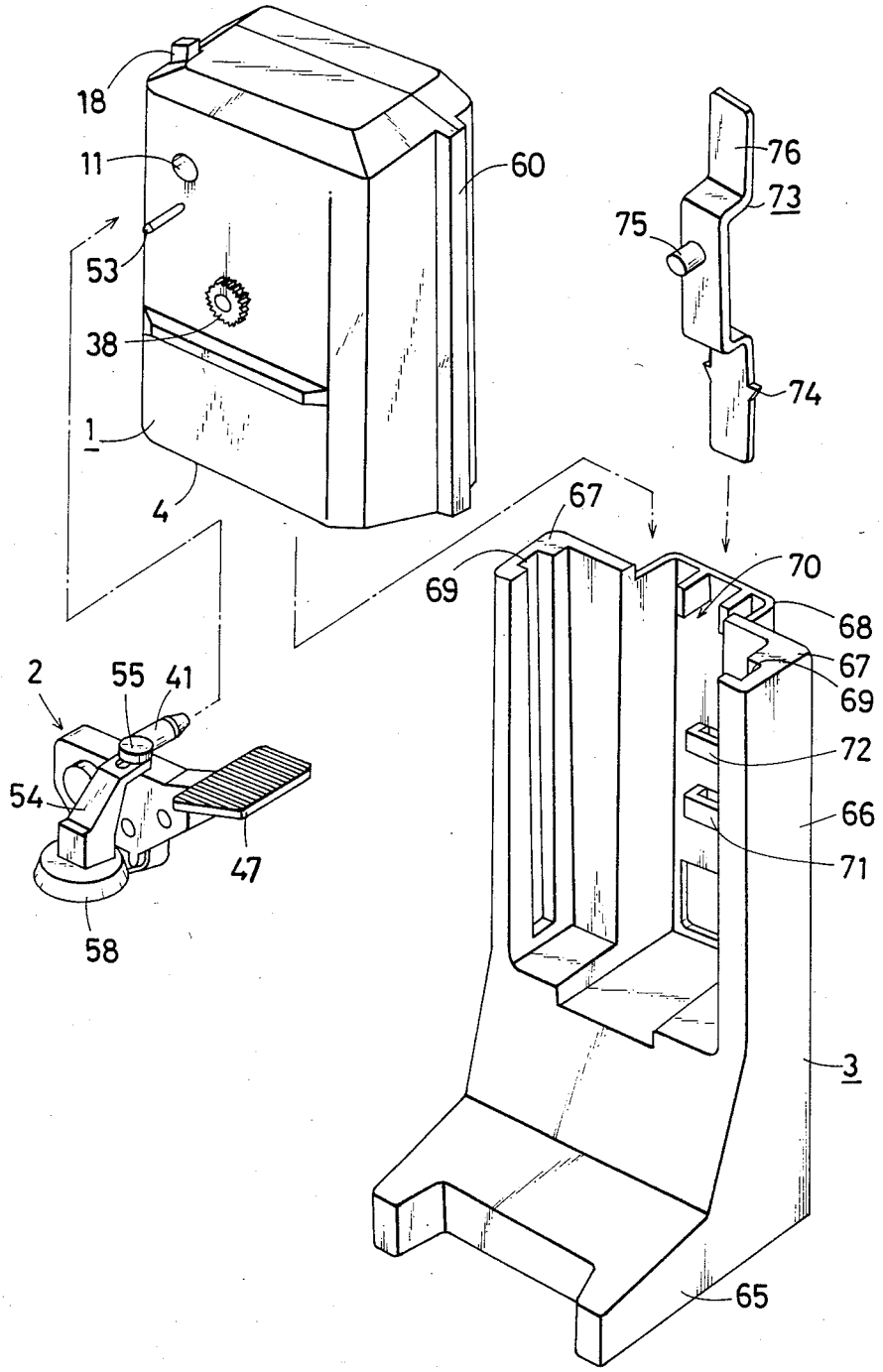
FIG. 3 is an exploded perspective view of the opener of FIG. 1.
Figure 4:
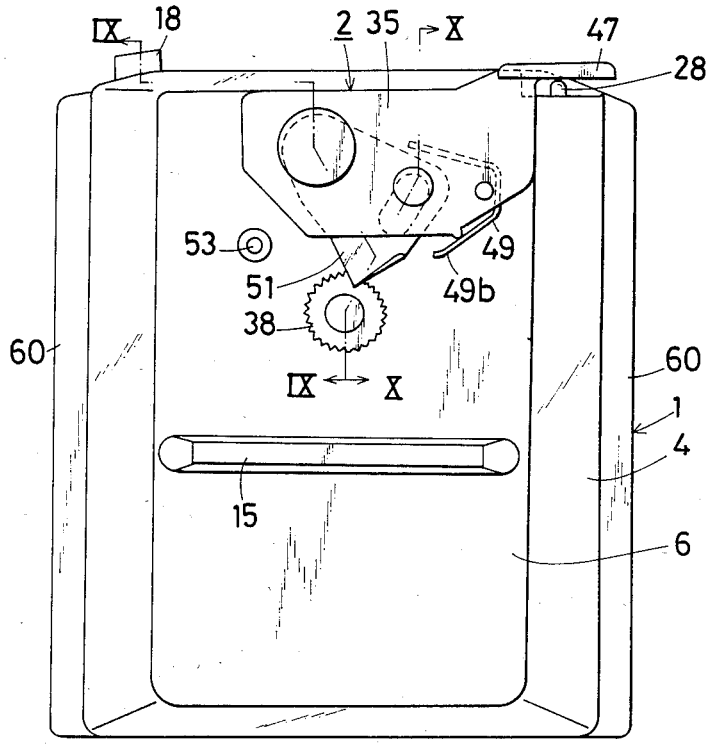
FIG. 4 is an elevational view of the body of the opener of FIG. 1.
Figure 15:
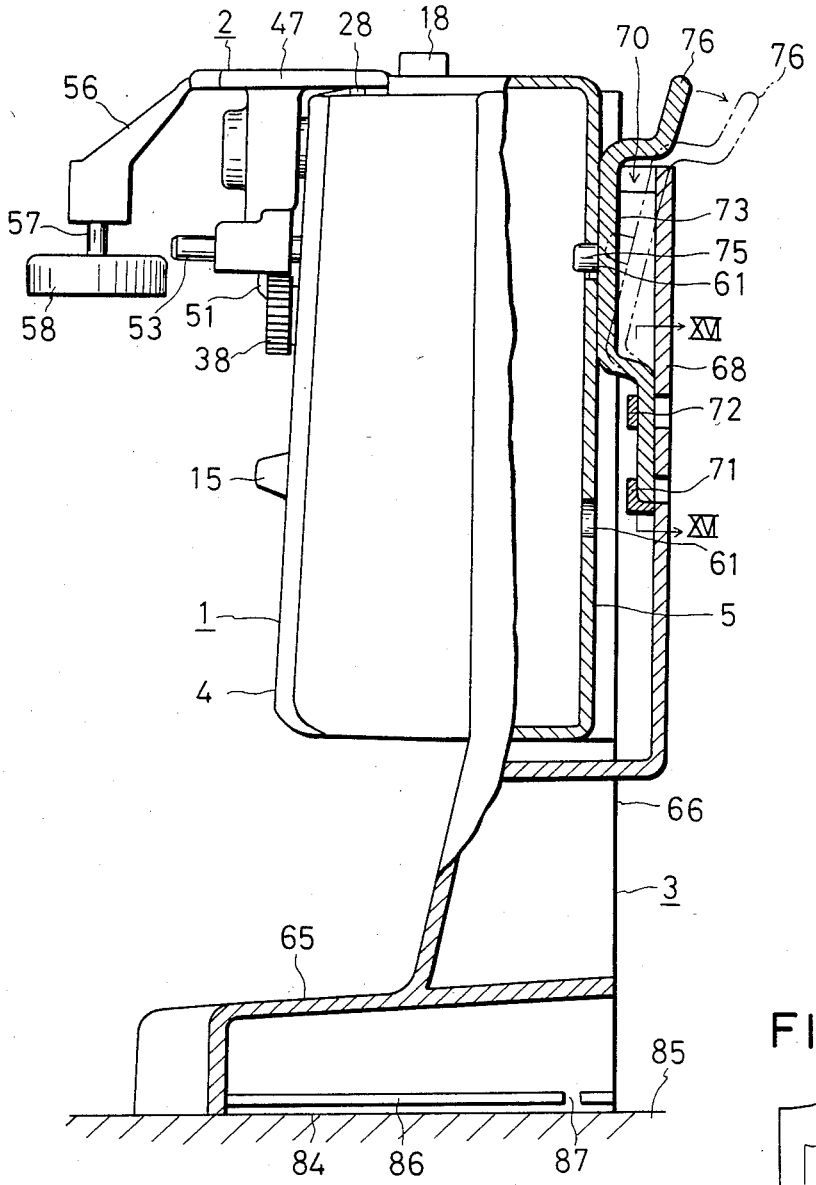
FIG. 15 is a partly sectional side view of the opener of FIG. 1, illustrating the relationship between the opener body and its support.
Figure 16:
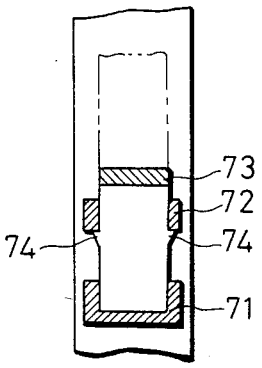
FIG. 16 is a cross section taken on the line XVI—XVI of FIG. 15.
Figure 17:
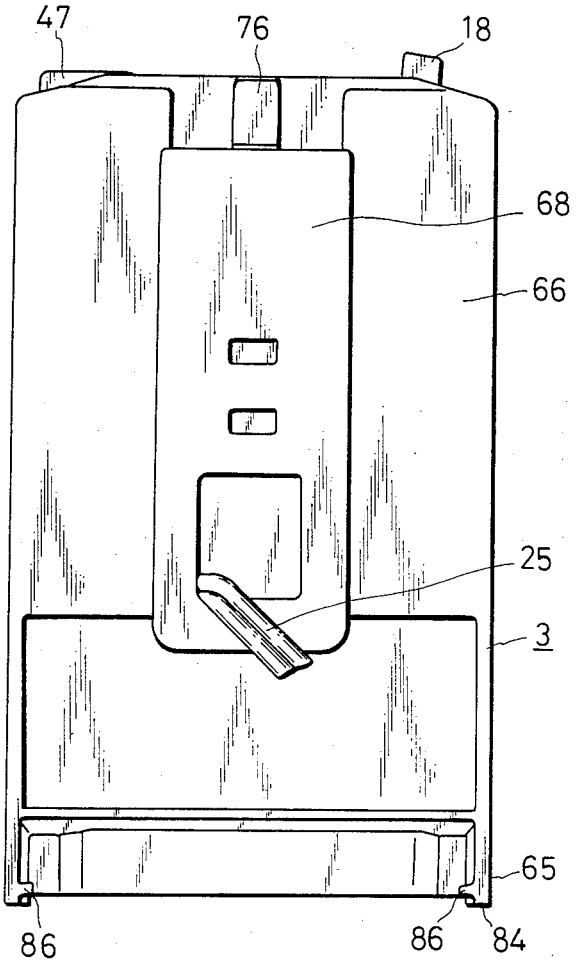
FIG. 17 is a rear elevation.
Figure 18:
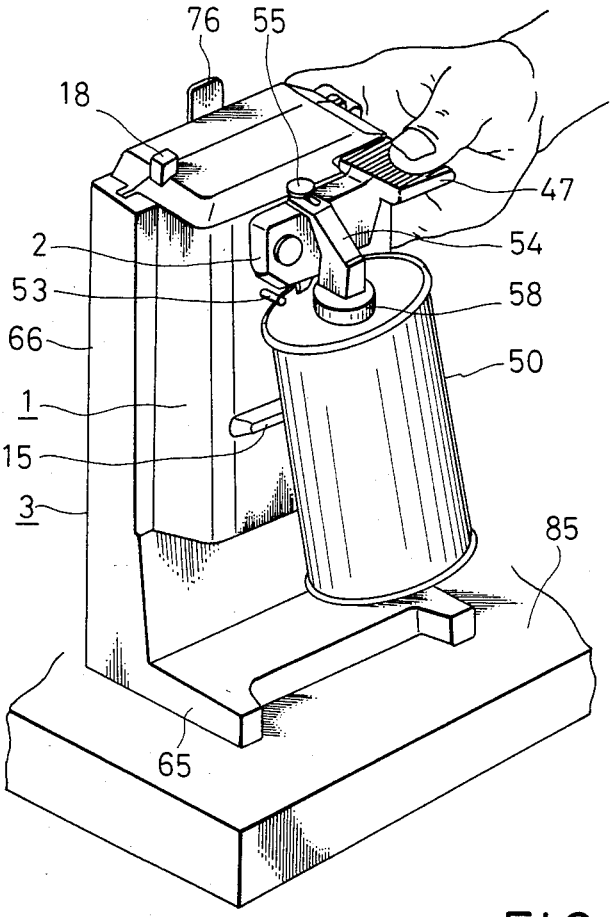
FIG. 18 is a perspective view of the opener of FIG. 1 in opening operation with its bottom placed on a table.
Figure 25:
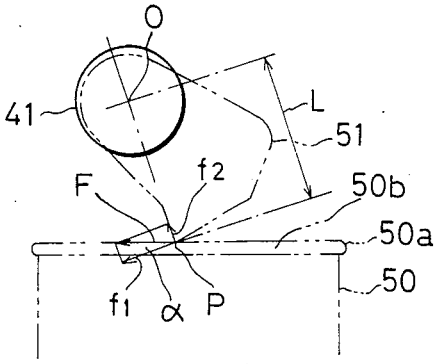
FIG. 25 illustrates the forces which act during opening operation.
Figure 19:
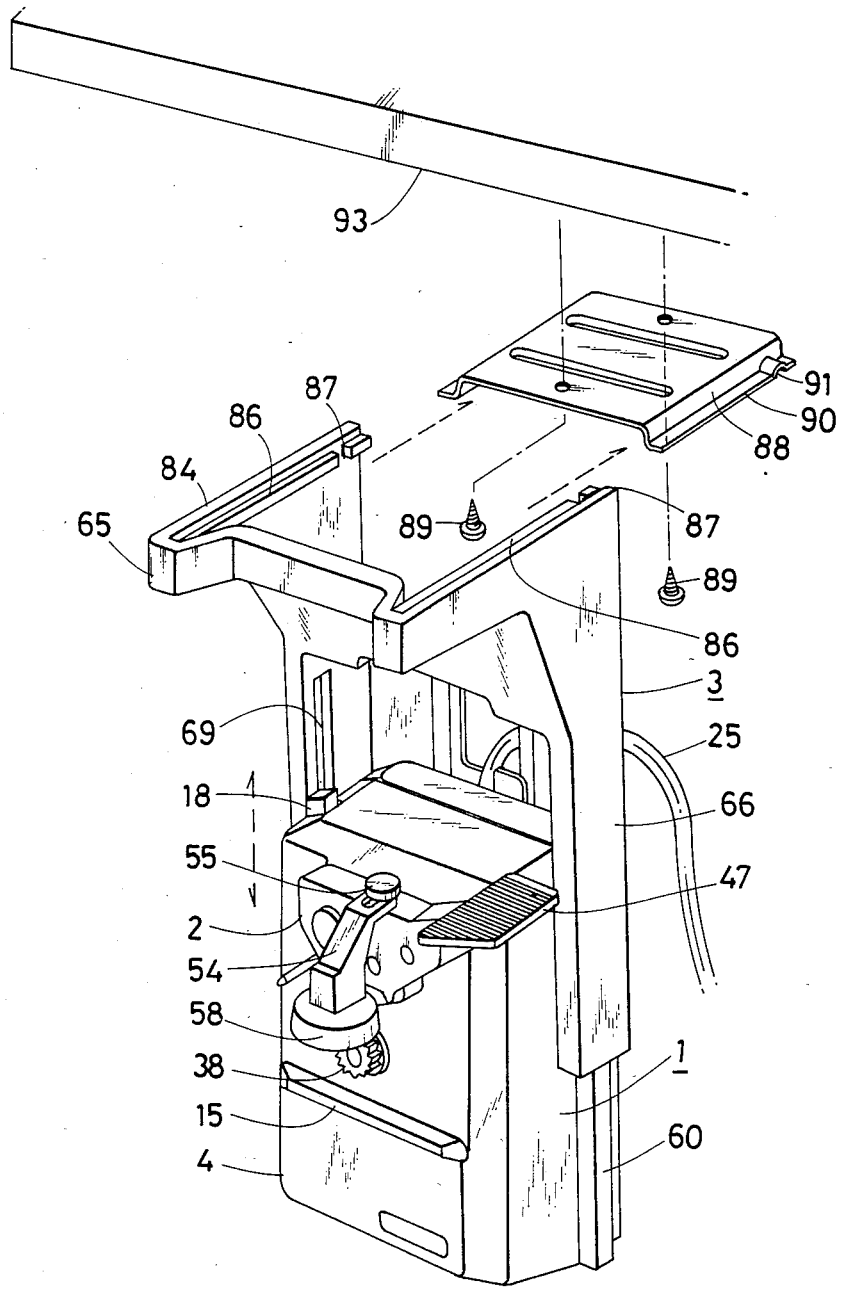
FIG. 19 is an exploded perspective view of the opener of FIG. 1 in preparation for the installation thereof to the bottom of a hanged sideboard.
Figure 20:
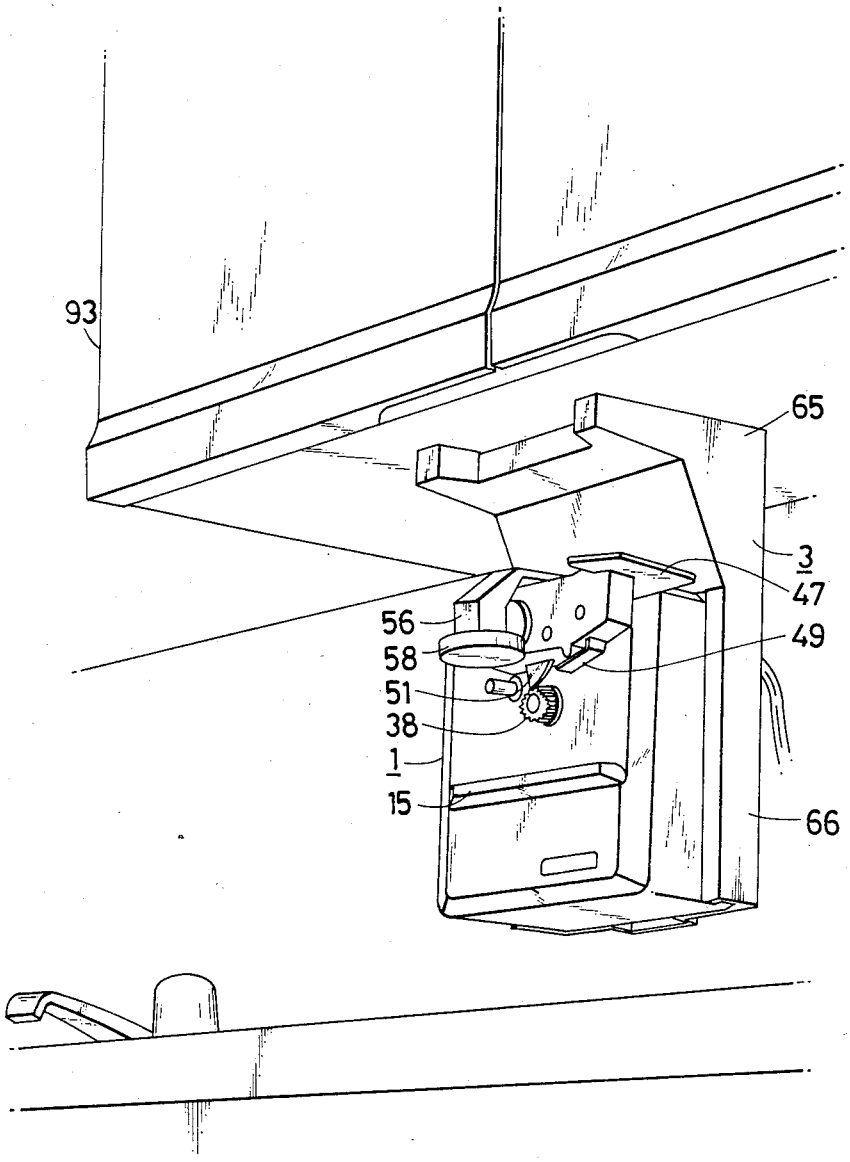
FIG. 20 is a perspective view of FIG. 19 as installed to the bottom of the sideboard.
Figure 21:
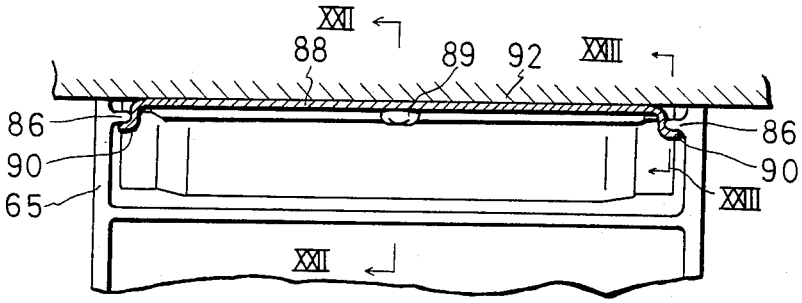
FIG. 21 shows details of a base of the opener of FIG. 20 installed to the sideboard.
Figure 22:
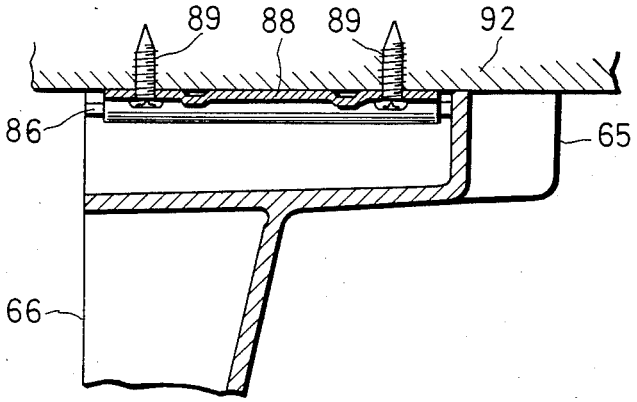
FIG. 22 is a cross section taken on the line XXII—XXII of FIG. 21.
Figure 23:
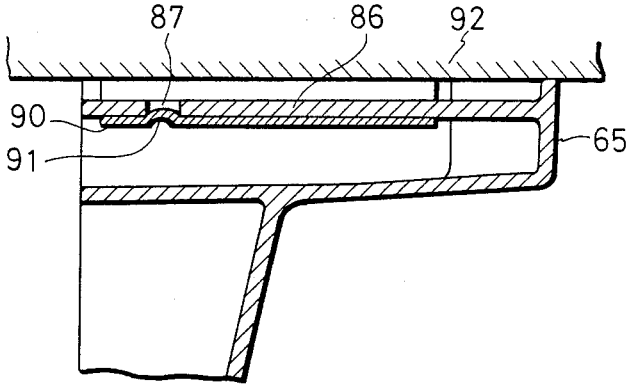
FIG. 23 is a cross section taken on the line XXIII—XXIII of FIG. 21.
Figure 24A:
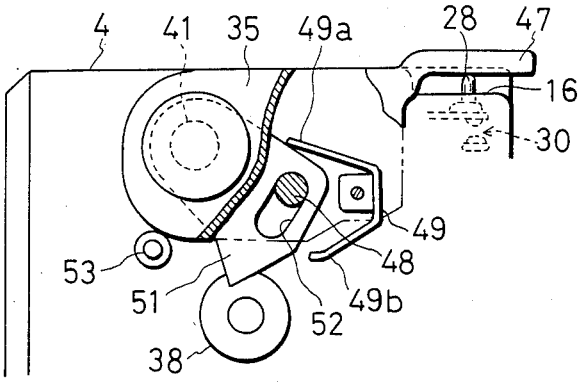
FIGS. 24A–24F illustrate the opening operation of the opener of FIG. 1.
Figure 24B:
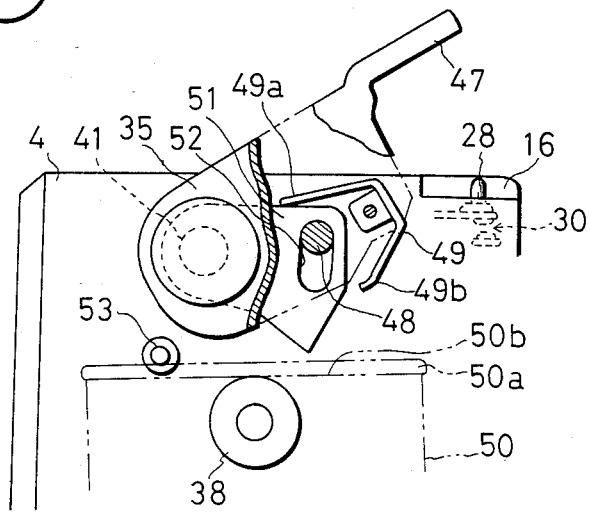
Figure 24C:
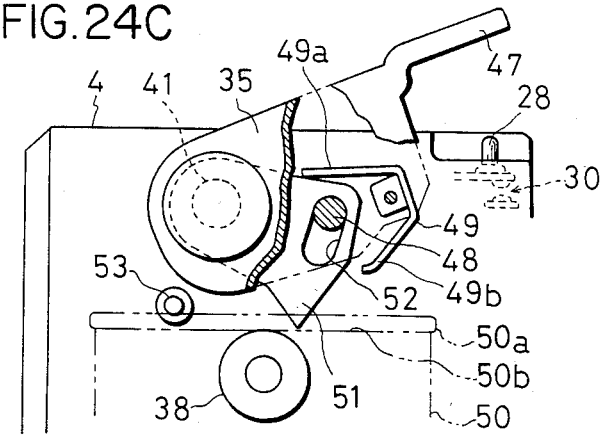
Figure 24D:
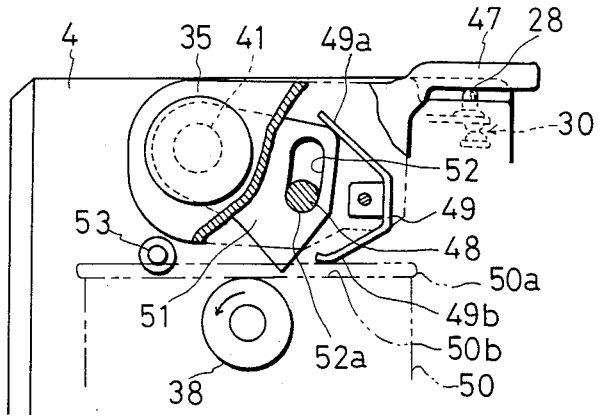
Figure 24E:
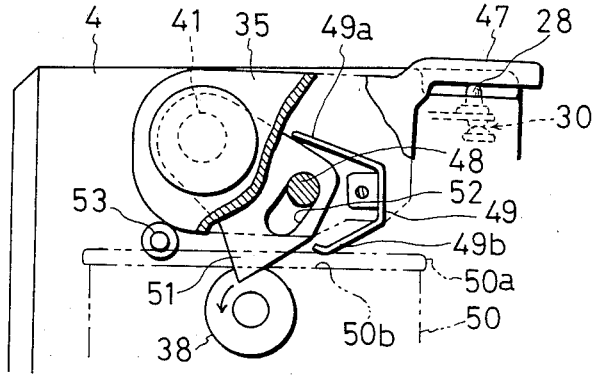
Figure 24F:
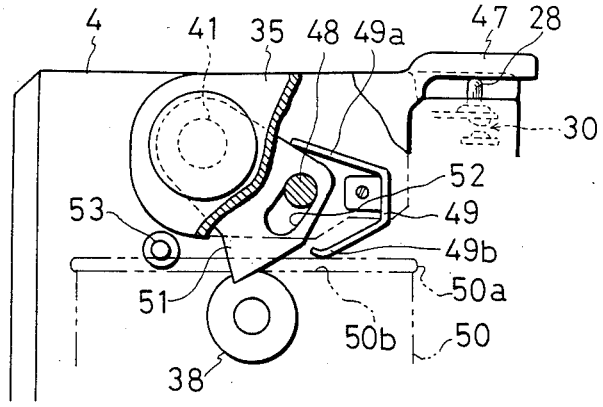
Figure 26:
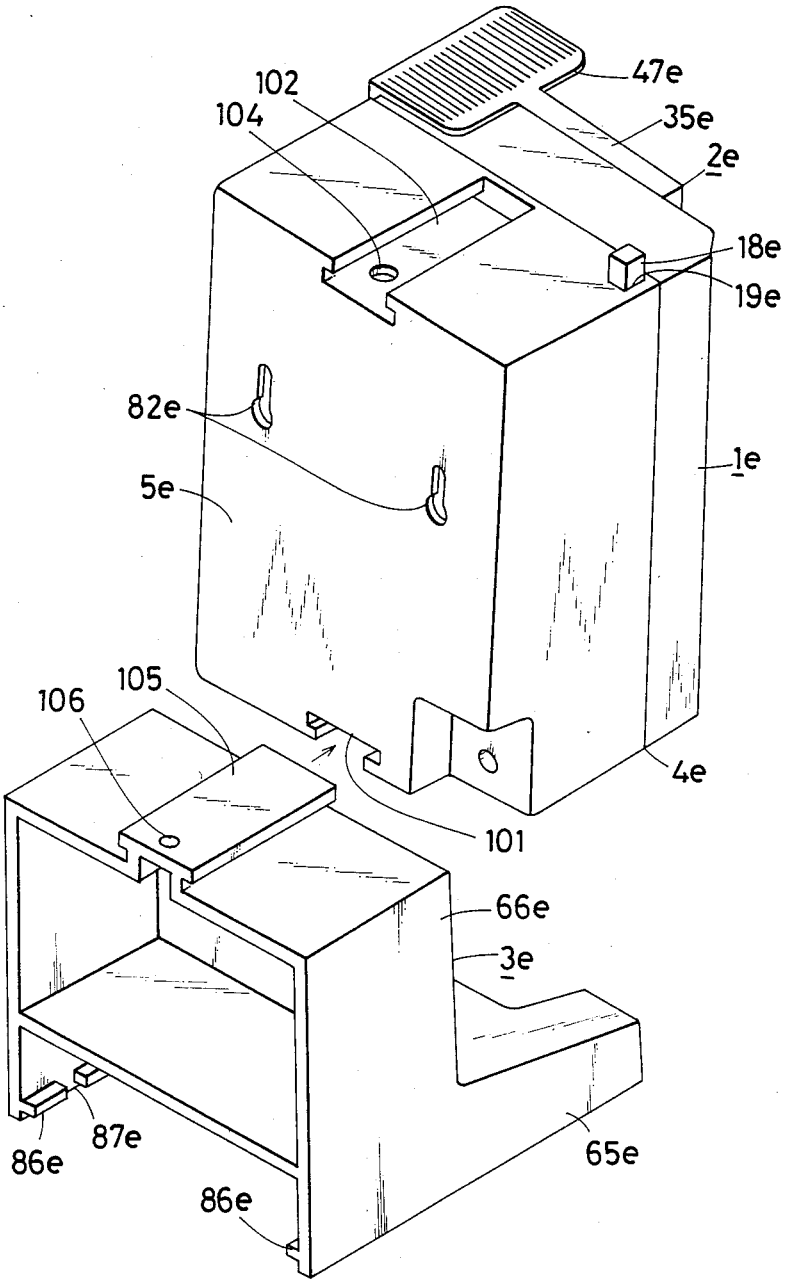
FIGS. 26 to 29 show a second embodiment of the invention.
Figure 27:
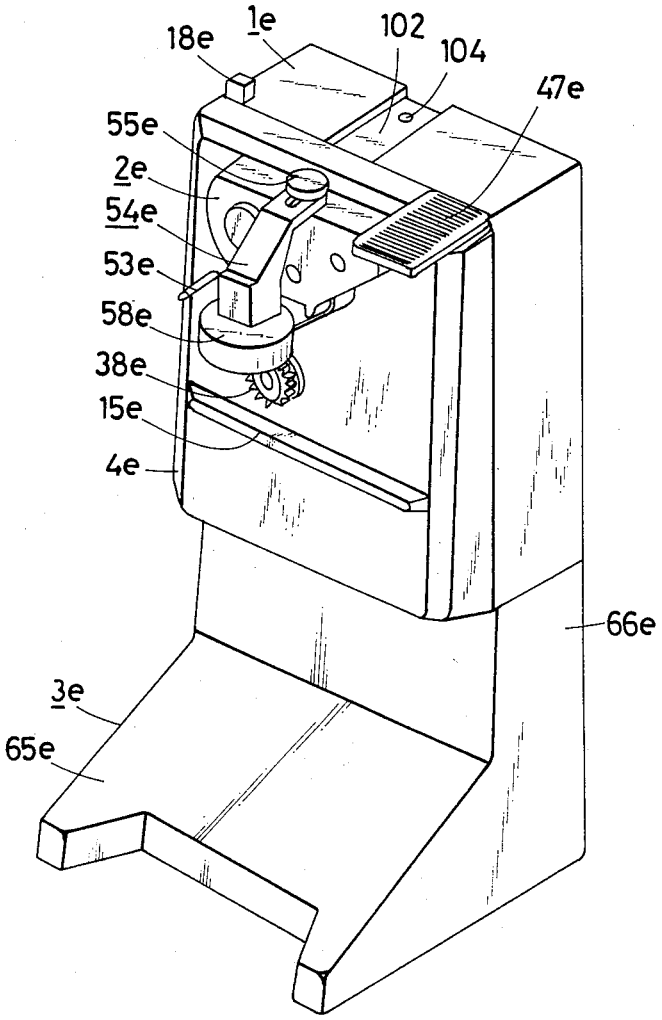
Figure 28:
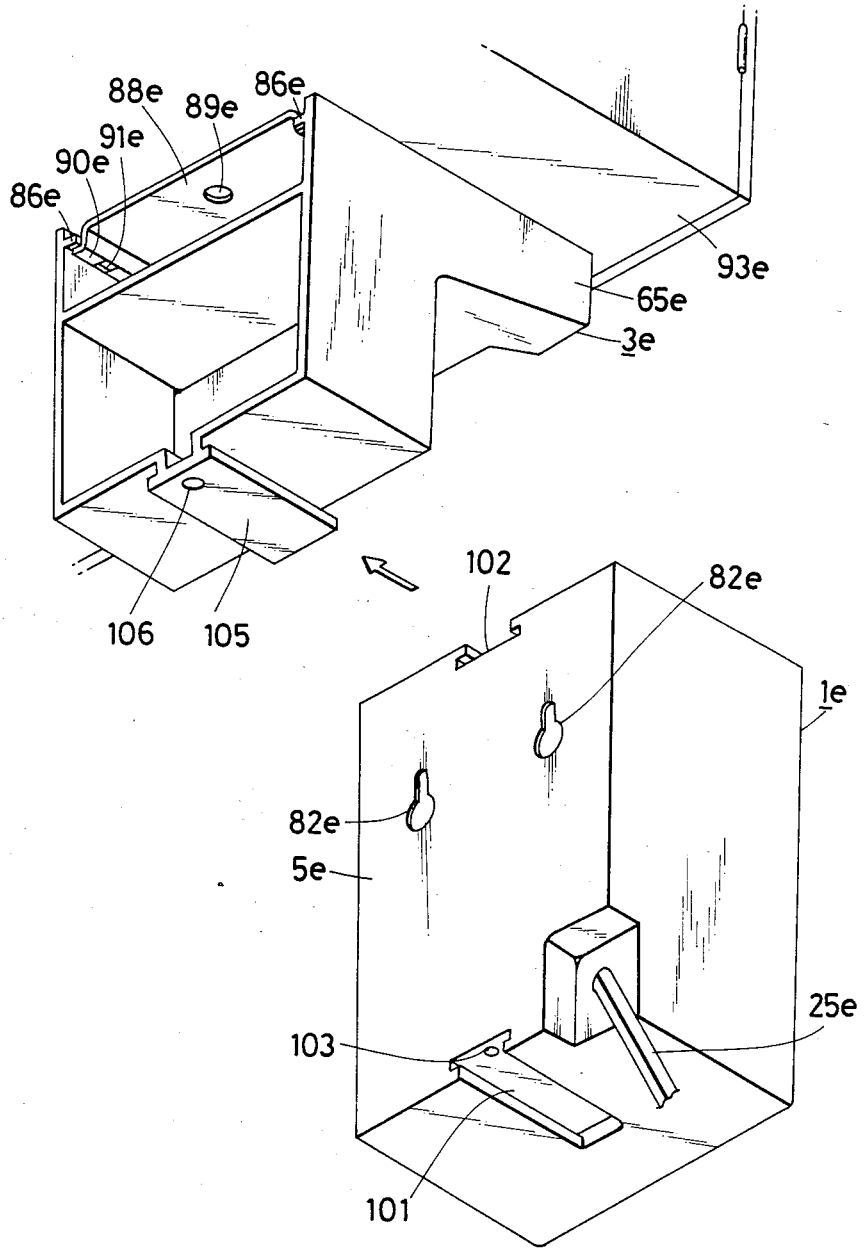
Figure 29:
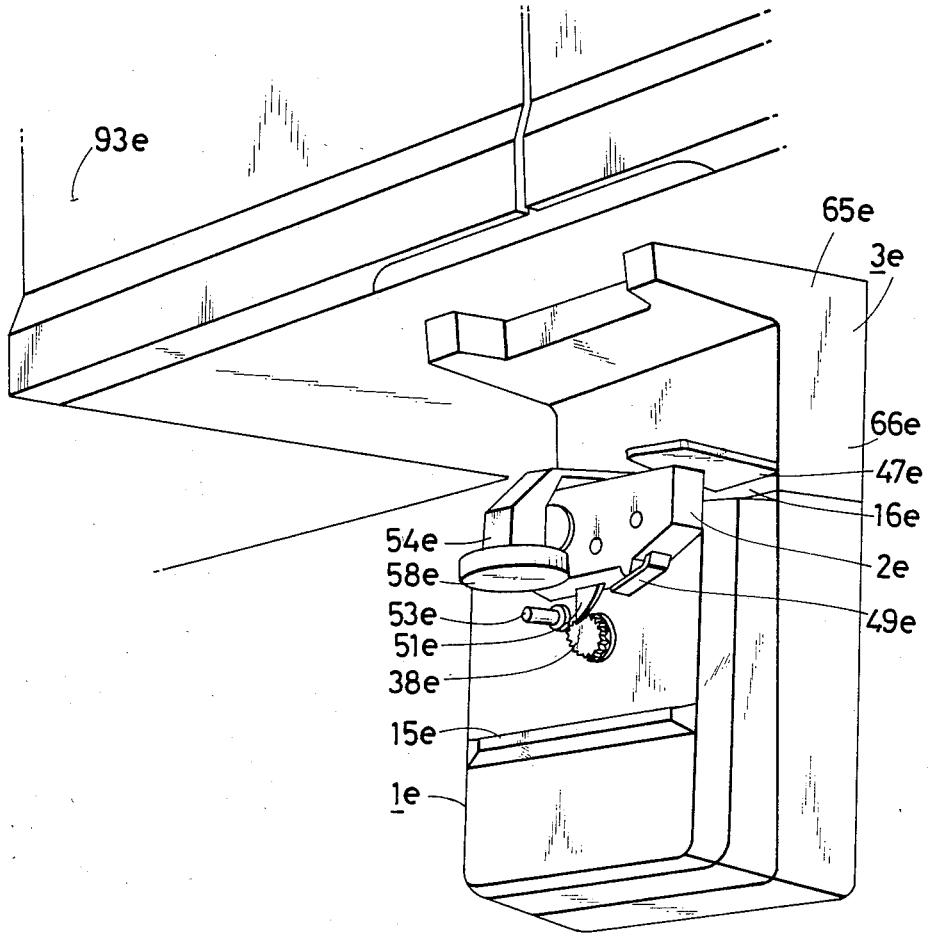
Figure 30:
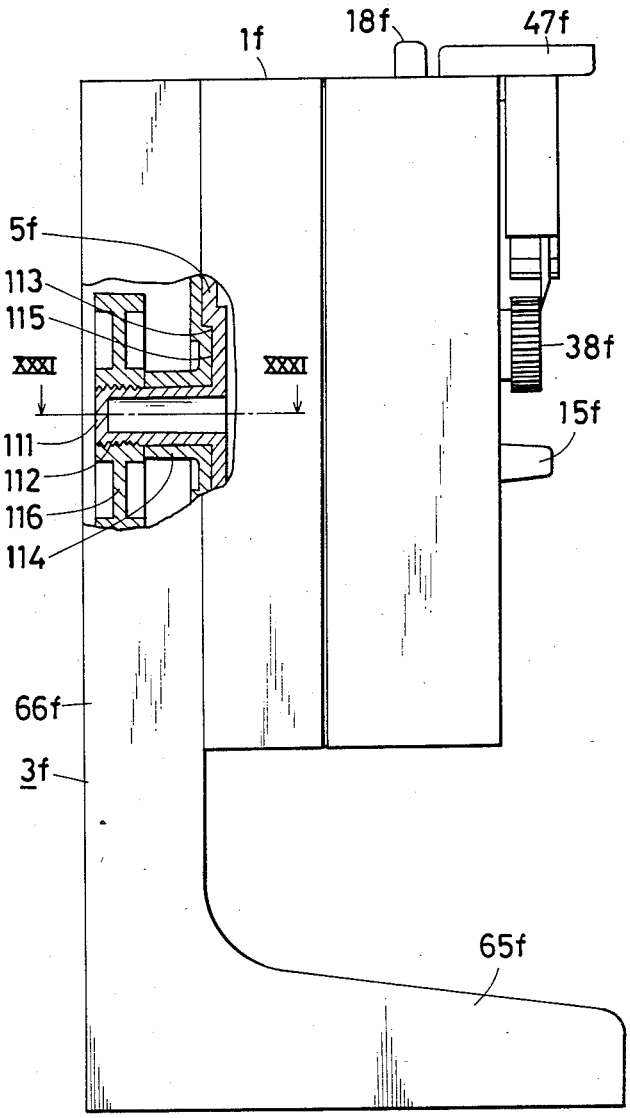
FIGS. 30 to 33 show a third embodiment of the invention.
Figure 31:
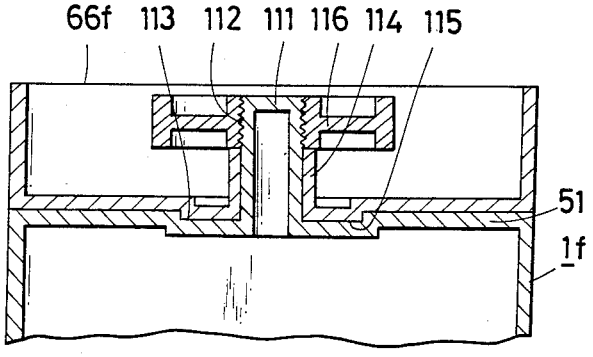
Figure 32:
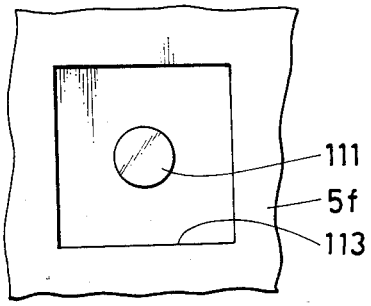
Figure 33:
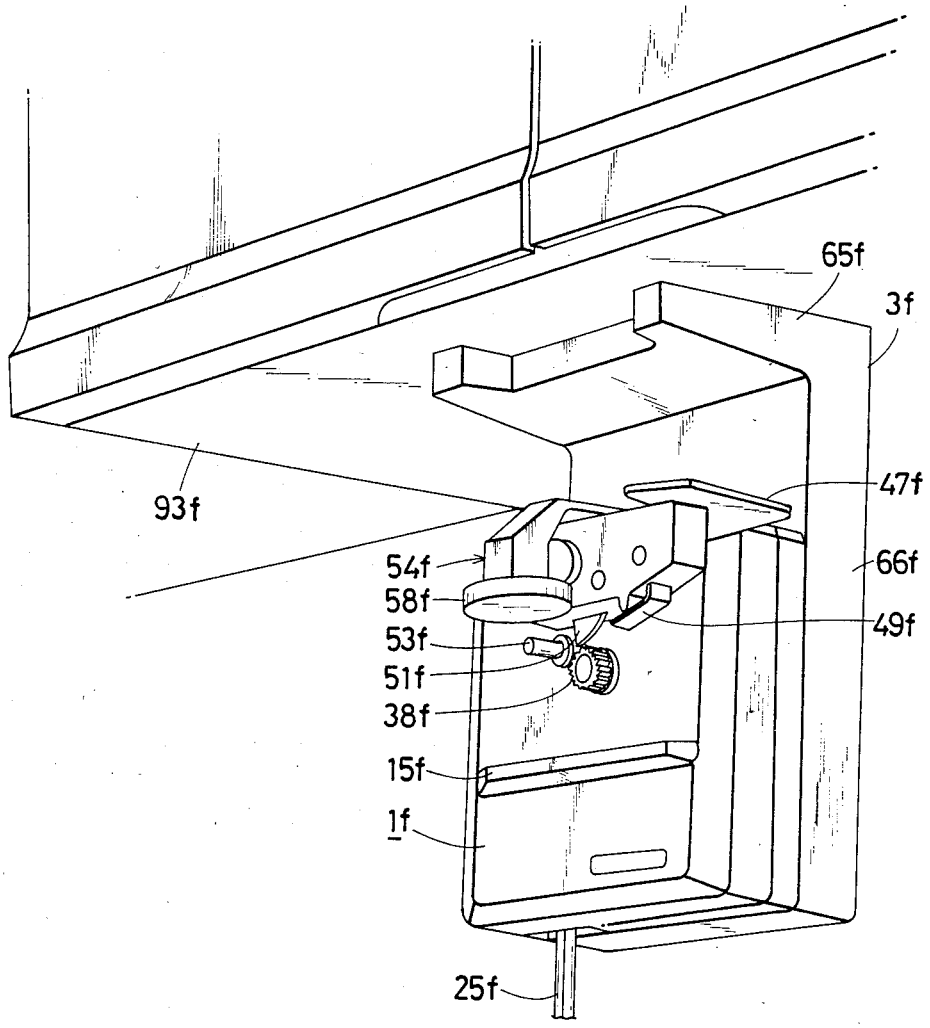

The body support 3 is of synthetic resin so molded as to provide a base 65 and a support wall 66 projecting upward therefrom. The support wall 66 includes side walls 67 and a rear wall 68 (FIG. 3). The side walls 67 are both provided, at their inner surfaces, with guide grooves 69 which extend vertically to receive the guide sections 60 of the body case 4. The rear wall 68 is recessed at its center to provide a housing section 70. The section 70 is provided with holder means 71 and 72 which are formed integrally with the rear wall 68 and vertically spaced apart from each other. The holder means 71 and 72 are similarly shaped except that the lower means 71 has a closed lower end (FIG. 15). A stopper means 73 of elastic molding (of polyacetal or other similar synthetic resin) is disposed in the housing section 70 and supported by the holder means 72 and 71 at its lower portion. The stopper means 73 has a pair of lateral projections 74 engaged with the lower surface of the upper holder means 72 so as to prevent the stopper 73 from detaching itself from the rear wall 68 (FIG. 16). The stopper 73 is also provided with a peg 75 projecting forward from its center and inserted into one of the engagement openings 61 of the case 4 (FIG. 15). The upper end of the stopper 73 provides a section to be manually held. The base 65 of the body support 3 is so constructed as to enable the support 3 to be installed on the upper surface of a fixed object or hung down from the lower surface thereof. Lower surface 84 of the base 65 is part of such a construction, enabling the support 3 to be placed on the upper surface of a kitchen table 85 or the like. The lower surface 84 is sufficiently dimensioned to stably support the body 1 on the upper surface of the table 85. The base 65 may be so constructed as to be screwed on the upper surface of a fixed object instead of being merely placed thereon. Numeral 86 designates a pair of bars connected to the inner surfaces of the side walls of the base 65 for installing the support 3 upside down (FIG. 19). Numeral 88 designates a plate to be used for such an installation in conjunction with the bars 86. For this purpose, the plate 88 is provided with a pair of bracket-shaped projections 90 on which to rest the bars 86 (FIG. 19). The installation plate 88 is a sheet metal press worked into the shape as shown in FIGS. 19, 21, 22, and 23, and is adapted to be secured to the lower surface of a fixed object 92 by using set screws 89, thus hanging down the support 3 from the lower surface of the object 92. The fixed object 92 may be, for example, a hanged sideboard 93 located in the upper space in a kitchen, as shown in FIG. 20. The projections 90 of the plate 88 are each provided with a rise 91 to engage with an opening 87 which is made in each bar 86 of the base 65 so as to correspond with the rise 91 (FIGS. 19 and 23).

Description will now be made of the use of the foregoing can opener. For use on the upper surface of the table 85 (FIG. 18), the body support 3 is placed thereon with the base 65 lowermost. Then, the top 76 of the stopper 73 is held, and the stopper 73 is flexed backward (FIG. 15). In this condition, the guide sections 60 of the body 1 are engaged with the guide grooves 69 of the support 3, thereby locating the body 1 in place. The stopper 73 of elastic material is then allowed to return to its original position (as shown by a solid line of FIG. 15), and its peg 75 is inserted into the upper or lower engagement opening 61 of the body 1 so as to fix the body 1 to its support 3. The selection of the upper or lower opening 61 to receive the peg 75 depends upon the height of a can to be opened. Although the foregoing embodiment has been described as having only the two engagement openings 61, more such openings may be made through the rear wall 5 of the body 1 in vertical alignment with one another, thus providing for a desired selection of installation level of the body 1 in a wider range as well as in a more precise manner.

After the opener has been assembled and placed as described above, the operation section 47 is manually raised to move the lower end of the cutter 51 above the top of the can-rotating gear 38 (FIGS. 24 (A) and (B)). In this condition, a portion of the projecting edge 50*a* of the can 50 is placed on the gear 38 while simultaneously engaging the top of another portion of the edge 50*a* with a hold-down pin 53 which projects forward from the front wall 6 of the case 4. Then, the operation section 47 is lowered to a position as shown in FIG. 24(C), thus allowing the lower sharp-pointed end of the cutter 51 to contact the periphery of the top of can inside its projecting edge 50*a*. In this condition, the user may release his hold of the can 50 as its edge 50*a*, in engagement with the gear 38, holds the can 50 against the opener. Next operation is to lower the section 47 to a position as shown in FIG. 24(D) so that the lower end 49*b* of the leaf spring 49 comes into contact with the edge 50*a* of the can, thus pressing the edge 50*a* firmly against the gear 38, and the section 47 depresses the push button 28 to make a connection in the power switch 30. By this operation, the drive motor 21 is energized to turn the gear 38 in a direction as indicated in FIG. 24(D) so that the can 50 is rotated thereby. During the operation from FIGS. 24(C) to (D), the edge (or lower end) of the cutter 51, in engagement with the edge 50*a* of can, is firmly pressed against the top 50*b* not only by the upper edge 49*a* of the leaf spring 49 pressing down the cutter 51, but by the pin 48 coming into contact with a lower end 52*a* of the opening 52. With such a pressure applied, a friction is caused between the cutter 51 and the top 50*b* of can so that the cutter 51 is subjected to a force to move the cutter to the left-hand side in FIG. 24(D). This force provides the cutter 51 with a clockwise angular moment about the pivot 41, thus casuing the cutter 51 to cut into the can 50. This mechanism is illustrated in greater detail in FIG. 25 where O and P designate the axis of the pivot 41 and the point of contact of the cutter 51 with the top 50*b* of can, respectively. Rotation of the can 50 causes a thrust F to be applied to the point P. The point O is located above the point P off to the left and at a predetermined angle with the point P. The thrust F imparts a component force f2 to act toward O and another component force f1 to act in a downward direction which crosses the imaginary straight line connecting the two points O and P at right angles. The component force f1 is equal to F cos $\alpha$ where $\alpha$ is the angle that the thrust F forms with its component force f1. In addition, the angle $\alpha$ is so set that f1 is greater than f2. Therefore, the point P is subjected to a clockwise angular moment of $L \times F \cos \alpha$ where L is the distance between the points O and P. Such an angular moment, produced by the rotation of the top 50*b* of can, causes the cutter 51 to cut into the top 50*b*. Therefore there is no need heavily to press down the section 47 to start the opening operation. While cutting the top 50*b* of can, the cutter 51 continues to be subjected to the foregoing angular moment, thereby providing the frame 35, through the pin 48, with a clockwise angular moment about the pivot 41 (FIG. 24(E)). Hence the operation section 47 is allowed to keep depressing the push button 28, thus keeping the power switch 30 closed, so that the cutter 51 can be operated without holding (or depressing) the section 47. When the cutter 51 has opened the can 50, the top 50*b* of can ceases to be rotated so that the cutter 51 is freed from its angular moment, thus releasing the frame 35 from its angular moment. Then, the frame 35 is rotated counterclockwise to a slight degree by the reaction force of the lower end 49*b* of the spring 49 pressing against the projecting edge 50*a* of the can (FIG. 24(E)). Accordingly, the operation section 47 is moved upward to release the push button 28 so that the switch 30 is opened to stop the rotation of the can 50. In this condition, the can 50 does not drop down not only since its edge 50*a* is engaged with the gear 38, but since the cutter 51 is in contact with the inner surface of the edge 50*a*. Finally, the can 50 is held with one hand, and the section 47 is raised with the other hand, as shown in FIG. 24(B), so as to locate the edge of the cutter 51 above the upper end of the edge 50*a* of can. Then, the can 50 is removed from the opener.

When the attachment 2 is to be removed from the opener, the button 18 is depressed to turn the holder means 12 upward so that the edge 14*a* of the opening 14 is disengaged from the engagement groove 44 of the pivot 41. Then, the top 34 of the pusher means 31, constantly pressing against the inner end of the pivot 41, pushes the pivot 41 forward. Next time the pivot 41 is entirely removed from the installation opening 11 by hand thus removing the attachment 2 from the case 4. The attachment 2 can be easily washed. When the attachment 2 is to be coupled to the case 4 again, the pivot 41 is inserted into the opening 11. As mentioned before, the end 43 of the pivot 41 is tapered and, when passing the opening 14*a* of the holder means 12, moves its edge 14*a* upward while contacting it (FIG. 9). Then, when the engagement groove 44 of the pivot 41 has come to the position as enclosed by the edge 14*a*, the edge 14*a* is engaged with the groove 44 by the action of the spring 24 so that the pivot 41 is securely fastened into the opening 11.

As mentioned before, the opener may be hung down from the lower surface of a fixed object such as the hanged sideboard 93 (FIGS. 19 to 23). For such an installation, the installation plate 88 is secured to the lower surface of the fixed object 92. Then, the body support 3 is turned upside down as shown in FIG. 19. In this condition, the guide sections 60 of the body 1 is engaged with the guide grooves 69 of the support 3 and the peg 75 is inserted into one of the installation openings 61 (as with the preceding assembling operation). Next time the bars 86 of the base 65 are slided along the upper surfaces of the projections 90 of the plate 88, and the rises 91 of the plate 88 are engaged with the openings 87 of the bars 86 (FIG. 23). The opener is thus hung as shown in FIG. 20.

A can is hung on the inverted opener in the same manner as described before, and the opener is operated also in the same manner. In the inverted installation, the rises 91 in engagement with the openings 87 protects the support 3 from sliding forward and removing from the installation plate 88.

For the above-mentioned installation, the support 3 may be hung from the plate 88 secured to the object 92 before coupling the body 1 thereto.

Figure 14:
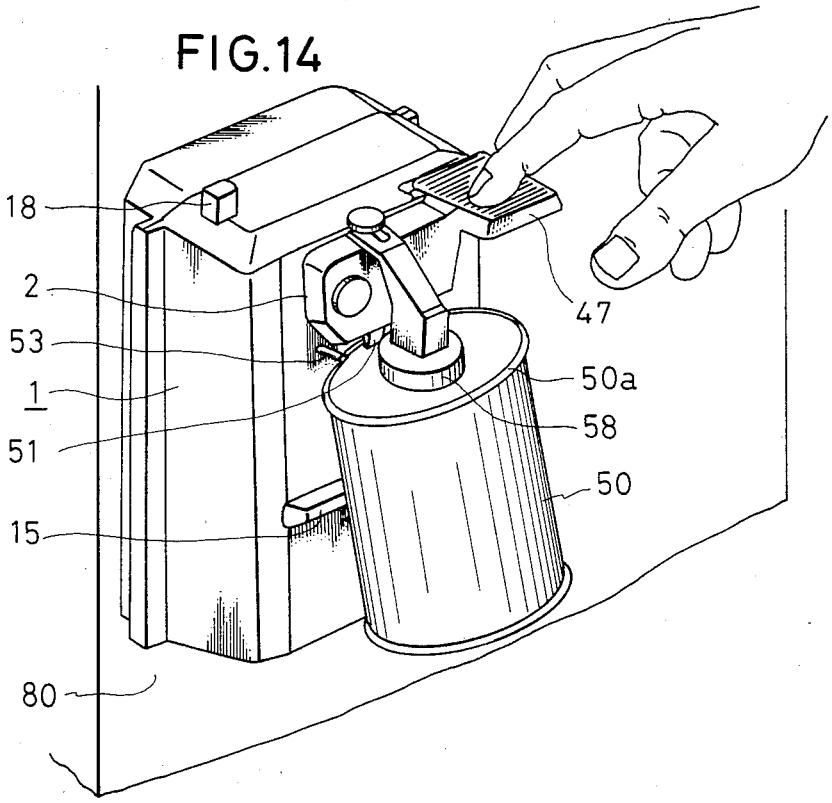
FIG. 14 is a perspective view of the opener of FIG. 1 in opening operation with its rear side secured to a wall.

Referring to FIGS. 7, 8, and 14, the opener may be secured to an object such as the wall 80. In such an installation, the support 3 is not employed, but the body 1 is directly mounted to the wall 80 (of a kitchen or the like) by using the bolts 81. For the installation, the openings 82 (not 61) are used. As shown in FIG. 5, the openings 82 each comprise a large-sized portion 82*a* and a small-sized portion 82*b* projecting upward therefrom. The bolts 81 are fixed in the wall 80 in advance, and then the body 1 is held against the wall 80 in such a manner that the larger portions 82*a* of the openings 82 receive the heads 81*a* of the bolts 81. Next time the body 1 is allowed to lower so that the shanks 81*b* of the bolts 81 are engaged with the smaller portions 82*b* of the openings 82. Thus the body 1 can be easily secured to the wall 80.

Figure 34:
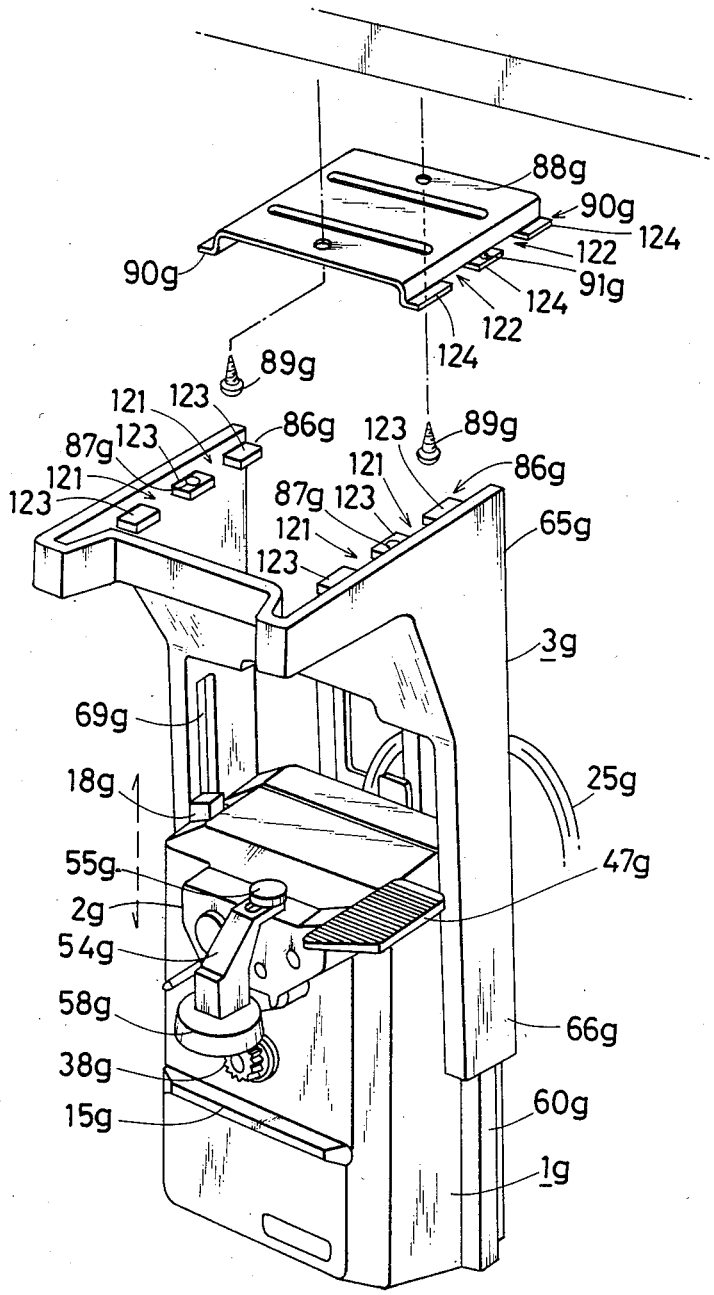
FIGS. 34 to 36 show a fourth embodiment of the invention.
Figure 35:
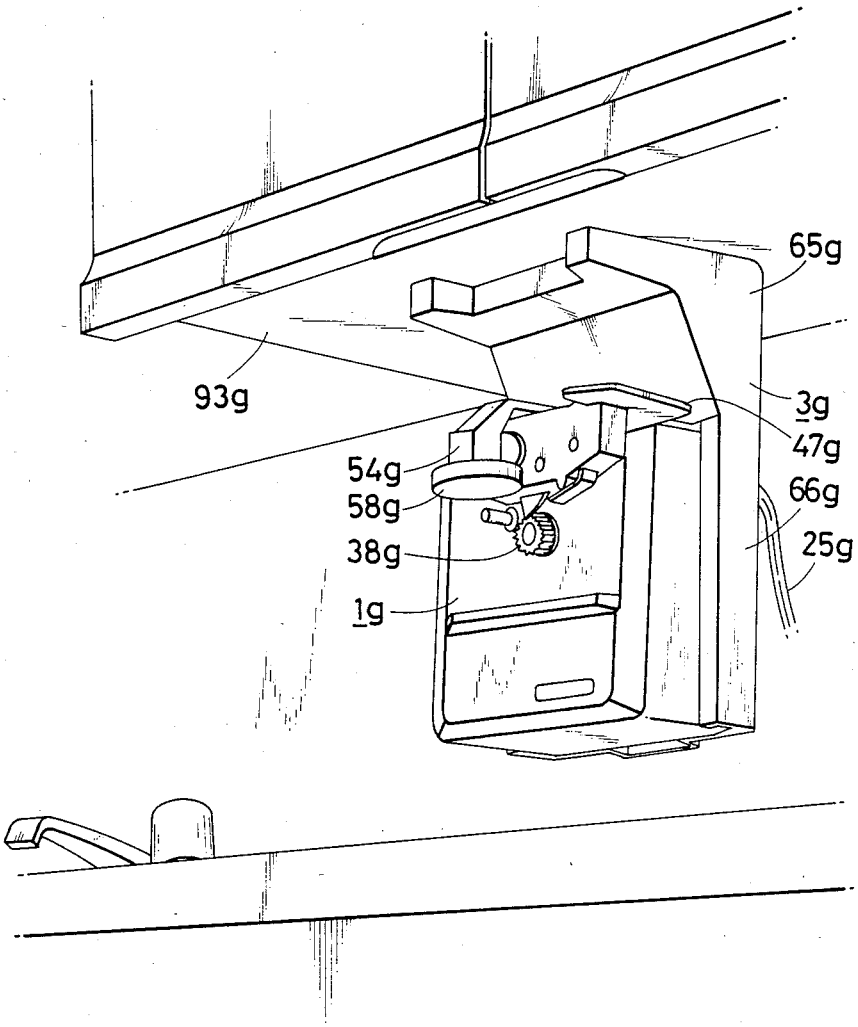
Figure 36:
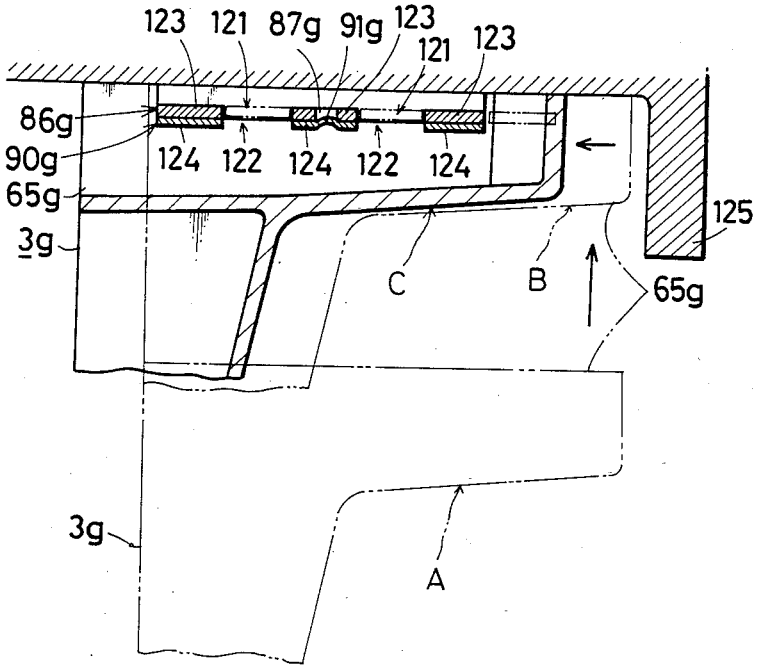

FIGS. 34 to 36 illustrate a still further embodiment of the invention which is, in some measure, different from the first embodiment in the arrangement for installing an opener onto the lower surface of a fixed object. As shown in FIG. 34, this embodiment can be obtained by cutting a number of portions away from both installation bars 86 and bracket-shaped projections 90 of the first embodiment (FIG. 19) so as to provide omission spaces 121 and 122. These spaces 121 and 122 are so dimensioned as to have lengths greater than those of the portions 124 and 123 not cut away from the bars and the projections. The portions 124 and 123 will be hereinafter referred to as a "suspension support" and a "suspension means", respectively.

For use of the opener in suspension from a fixed object, a base 65*g* of a support 3*g* is to be moved upward from positions A to B (FIG. 36). For this operation, the suspension means 86*g* must be passed through the omission spaces 122 of a installation plate 88*g* (as secured to the object). Then, the base 65*g* is moved from positions B to C so as to rest the suspension means 86*g* on the suspension support 90*g* and engage rises 91*g* with openings 87*g*. The opener is thus hung down from the lower surface of the object.

The foregoing arrangement enables the opener to be suspended from the lower surface of an object even if the front end of the surface has an obstruction such as indicated by numeral 125 in FIG. 36.

As many apparently widely different embodiments of this invention may be made without departing from the spirit and scope thereof, it is to be understood that the invention is not limited to the specific embodiments thereof except as defined in the appended claims.

What is claimed is:

1. A can opener comprising:

(a) a rectangular enclosure containing a motor, a gear rotated by said motor for rotating a can to be opened and a cutter for cutting the can top as the can is rotated;

(b) a support member for said enclosure having a bare and an upright rear wall and provided with a compartment for removably receiving said enclosure and removable means cooperating with the support member and enclosure for interlocking the enclosure and support member to form a single unit;

(c) means for removably and rigidly suspending the single unit from an overhead support whereby the can opener can be operated with the support member mounted either on a vertical wall, a horizontal surface or when suspended from above wherein the compartment in the support member is a forwardly and upwardly open recess, the side walls of the recess being formed with oppositely facing elongated grooves, and the enclosure having vertically extending guides projecting from the opposite walls of the enclosure for slidable engagement with the grooves and wherein the removable means for interlocking the support member and enclosure when it is within the compartment includes bracket means secured to the rear wall of the recess, at least one opening in the rear wall of the enclosure, an elongated resilient member provided with lateral projections for interlocking with the bracket means and a forwardly directed projection extending said at least one into an opening.

2. A can opener according to claim 1 wherein the means for suspending the single unit comprises first means secured to an overhead support and second means within the base of the support member interlocking with said first means.

* * * * *